US007568584B2

(12) United States Patent
Brough et al.

(10) Patent No.: US 7,568,584 B2
(45) Date of Patent: Aug. 4, 2009

(54) DRAFT SILL WEAR LINER

(75) Inventors: Steve A. Brough, Gardners, PA (US); Tomasz W. Malinowski, Chambersburg, PA (US)

(73) Assignee: ASSF-Keystone, Inc., Granite City, IL (US)

( * ) Notice: Subject to any disclaimer, the term of this patent is extended or adjusted under 35 U.S.C. 154(b) by 345 days.

(21) Appl. No.: 11/487,085

(22) Filed: Jul. 17, 2006

(65) Prior Publication Data

US 2008/0011700 A1 Jan. 17, 2008

(51) Int. Cl.
*B61G 7/10* (2006.01)
*B61G 9/20* (2006.01)

(52) U.S. Cl. ..... 213/51; 213/50

(58) Field of Classification Search ..... 213/50–53, 213/60, 61
See application file for complete search history.

(56) References Cited

U.S. PATENT DOCUMENTS 1,947,936 A * 2/1934 Glascodine ..... 213/50
4,238,039 A * 12/1980 Cooper et al. ..... 213/61
4,249,664 A * 2/1981 Murphy ..... 213/61
4,264,015 A * 4/1981 Mathieu ..... 213/61
4,591,059 A * 5/1986 Hammarlund ..... 213/32 R
5,054,630 A * 10/1991 Altherr ..... 213/56
2008/0011700 A1* 1/2008 Brough et al. ..... 213/75 R

* cited by examiner

*Primary Examiner*—S. Joseph Morano
*Assistant Examiner*—Jason C Smith
(74) *Attorney, Agent, or Firm*—Edward J. Brosius

(57) ABSTRACT

A liner for use in a draft sill to protect the sill from damage and wear caused by draft gear movement. The draft gear is attached to a coupling to transmit moving forces from the coupling to the car causing. The draft gear is isolated from the side walls of the draft sill by the liner to reduce wear on the draft sill as the draft gear absorbs and cushions impacts from the buff and drag events. These impacts may cause the followers, yoke and resilient members move toward the side walls and contact the liner disposed between the draft gear and the draft sill for protecting the side walls from damage and wear.

4 Claims, 4 Drawing Sheets

13
37
84
36
90
92
40
10E
72
98
66
100
98
24E
32
94
30
45
58
44
72
98
11
28
46
26E
47
58

11
16
d2
106
112
14
116
99
208
99
110
48
108
18
110
109
118
104
15
13

22
21
26
10
92
90
108
116
15
20
32
13
120
24
99
100
44
15
117
106 d7
d6
21
15
26
18
28
44
30
109
90
32
20
13
120
111
100
52
113
122
116

DRAFT SILL WEAR LINER

BACKGROUND OF THE INVENTION

The present invention relates to railcar coupling systems, and more particularly to rail car connection assemblies comprising draft gears and draft sills and couplers in railcars.

Rail cars are interconnected by couplers attached to draft gear assemblies at the ends of adjoining railroad freight cars. The draft gear assembly is disposed in the draft sills at the ends of the freight cars. The draft sills are commonly cast or fabricated sills that are mounted at the ends of the center sills of the railcar. The sidewalls of the draft sill each have a front stop and a rear stop, with a draft gear pocket between the stops. The draft gear assembly is received in the draft gear pocket. The draft rear is connected to the coupler and adapted to transfer motion to the car while absorbing impacts from train action events. A front resilient member cushions the coupling from impacts caused by draft events where the coupling is pulled away from the car. A rear resilient member is built into the draft gear to protect the coupling from buff events where the coupling is forced toward the car. This movement of the coupling causes an expansion and compression of the resilient members and movement of the yoke and followers of the draft gear.

The components of the draft gear may deflect from the axis of the draft sill causing the yoke, followers or resilient members to come in contact with the draft sill sidewalls inside the draft gear pocket. This contact can be very severe causing damage to the draft sill. The damage increases the maintenance and reduces the service time for the car. Draft sills are adapted to allow replacement of the draft gear and coupling but, draft sill repair requires more time and labor.

DESCRIPTION OF THE RELATED ART

Rail car coupling systems such as the Rail Car Gear Assembly and System disclosed and claimed in U.S. Pat. No. 6,446,820 and the Common Cast Draft Sill for Type E and F Draft Gear disclosed and claimed in U.S. Pat. No. 6,986,432 are commonly owned by the assignee of the present invention Amsted Industries, Inc., are hereby incorporated in their entirety. These systems comprise a steel draft sill having the draft gear mounted therein.

In the '820 patent for the Rail Car Gear Assembly and system discloses and claims an improved dampening system for use in absorbing shock caused by the impact of cars in a start or stop condition or during a changing load. Each draft gear assembly is connected to one coupler, and couplers of adjacent rail cars are connected to form the train. The train may be hundreds of cars long and drawn by one or more locomotives. Typically, there is a limited amount of slack or free movement allowed between the cars; generally there is about two (2) inches of slack. This slack permits the rail cars limited movement toward and away from each other in response to train action and yard impact events. The integrity of the draft sill is important for safety reduced operating cost and performance. Excess wear on the inside of the sidewalls of the draft sills causes premature failure or increased maintenance.

The '432 patent discloses and claims a draft sill having a common design for use with E and F type draft gear. The '432 patent has common design features to reduce the components needed to maintain rail cars. The '432 patent discloses and claims a draft sill for use with more than one design of draft gear.

Train action events include, for example: locomotive start up and acceleration, moving up and down inclined terrain, dynamic braking, differences in braking forces of adjacent cars, and gravity-induced movement of the cars as the train moves onto and away from inclines. Yard impact events include "humping" of the individual cars to build the train in the yard; in humping, a car is pushed over a hump in the track in the yard, released and allowed to roll down the incline of the hump toward an awaiting car; during humping, the released cars can reach speeds of 4-10 mph and can severely impact the coupler of the awaiting car.

Train action and yard impact events both subject the couplers of the cars to buff impacts, and train action events also subject the couplers to draft impacts. These impacts are transmitted from the couplers to the draft gear assemblies to the rail car body. That is, as the couplers are pulled or pushed, the movement is translated to the freight car body through the draft gear assemblies. Typical draft gear assemblies include a yoke element that is connected to the coupler through a pin or key, a coupler follower and a draft gear, as well as other elements. Generally, the coupler follower is positioned against or closely spaced from the butt end of the coupler in the draft gear pocket, within the yoke. The draft gear is positioned between the coupler follower and the rear stops of the draft sill; other elements, such as a wedge, may be interposed between the draft gear and the coupler follower.

In buff events, the butt end of the coupler moves inward against the coupler follower toward the rear stops of the draft sill. As the coupler and coupler follower are moved rearward, the shock of the movement is transferred to the draft gear. The draft gear typically absorbs and dissipates some of the energy from this shock through friction. Friction within the draft gear is acceptable as a means for absorbing the impact because the draft gear is replaceable. Friction between the draft gear and the draft sill is not acceptable as it causes damage to the draft sill that is harder and more expensive to repair or replace.

In draft events, slack is taken up between adjacent cars beginning at one end of the train and ending at the other end of the train. As a result of the slack being progressively taken up, the speed differences between the railcars increases as the slack at each coupler pair is taken up, with a resultant increase in buff and draft impacts on the couplers. For instance, during locomotive acceleration of a 50-car train from rest there is a total of 100 inches of slack between the 50 pairs of couplers in the train. This slack is taken up progressively, coupler pair by coupler pair. When the 2 inch slack in the coupler pair joining the last car to the train is taken up the next to the last car may be moving at a speed of 4 miles per hour. The slack in the last coupler pair is taken up very rapidly and the last two cars are subjected to a very large impact capable of injuring the lading or the car. The impact causes the resilient members of the draft gear to expand or compress creating a possible frictional engagement between parts of the draft gear and the sidewalls of the draft sill causing damage.

Various types of draft sill have been proposed and used. In U.S. Pat. No. 5,931,101 issued on Aug. 3, 1999 to Kaufhold et al. for an invention a LIGHT WEIGHT DRAFT SILL is commonly owned by Amsted Industries, Inc., the assignee for the present application for patent. The '101 patent discloses and claims a draft sill that is lighter weight by removing material in specific locations on the draft sill. The draft sill may still be susceptible to failure due to wear between the draft gear and the draft gear because of less steel used to reduce weight. Accordingly there is a need for an invention to protect the draft sill from damage by the movement of the draft gear. The patent U.S. Pat. No. 5,931,101 for a LIGHT WEIGHT DRAFT SILL is hereby incorporated in its entirety in this application.

Some draft gear assemblies employ mechanical springs and steel friction members held in a steel housing that is received in a yoke (FIG. 5). Other draft gear assemblies employ elastomer springs (FIG. 2). The steel housing adds to the weight of the railcar and may rub against the draft sill. Those employing elastomer springs or steel springs or plates for resilient absorption of the impact of buff and draft events may cause rubbing and friction between the springs and the sill. The friction causes heat and fatigue of the draft sill that will lead to premature failure of the draft sill or increased maintenance. There is a need to protect a draft sill to prevent premature failure due to friction on the draft gear assembly and other devices around it.

SUMMARY OF THE INVENTION

The present invention addresses the problems incident to train action and yard impact events as it affects the coupling of two cars together and problems with the impact on couplers during operation of the rail car causing wear on the draft sill. The present invention addresses these problems in a manner that is useful in applications such as freight, tank cars, grain cars and coal cars, where it is desirable to protect the railcar, by protecting the integrity of the coupling assembly, from damage due to train action and yard impact events. The present invention may be used in other applications as well.

In one aspect, the present invention provides a rail car coupling assembly comprising a draft sill, a draft gear assembly and a draft sill liner between the draft gear and the draft sill. The liner for use with railcars having coupler members. The draft sill comprising a front or outboard end, two side walls, a top and a bottom. The draft gear assembly has front and back ends and comprises a yoke, a coupler follower, at least one front resilient member, and at least one back resilient member. The yoke has a back wall, a top wall extending from the back wall toward the front end of the draft gear assembly, and a bottom wall extending from the back wall toward the front end of the draft gear assembly. The coupler follower is positioned between the back wall of the yoke and the front end of the draft gear assembly. The front resilient member is positioned between the front end and the back wall of the yoke. The back resilient member is positioned between the back wall and the back end of the draft sill. The front and back resilient members are compressible. The liner is disposed intermediate the draft gear and the draft sill side walls to hold the draft gear and the side walls in spaced relation to each other and protect the draft sill from wear or damage.

In another aspect, the present invention provides a liner for use with a railcar having a coupler member, a draft gear, and a draft sill. The draft sill having front and rear stops defining a draft gear pocket to receive at least part of the draft gear assembly. The liner is disposed in the draft gear pocket extending along the length of the pocket between the front stops and rear stops adjacent the inside of each of the two vertical side walls to isolate the draft gear pocket from the draft sill side walls. The liner is adapted to fit in the draft gear pocket by a liner length smaller than the pocket length of the pocket.

In another aspect of the present invention, the liner is adapted for use in a train car coupling assembly using an E-Type coupler wherein the liner is disposed in the draft gear pocket of a draft sill along the inside of the side walls of the draft sill. The liner extends from adjacent the front stop in the draft gear pocket to a position adjacent the rear stop in the draft gear pocket to isolate the draft gear from the draft sill side wall between the front and rear draft gear stops. The liner also extends from the top of the draft sill to a position adjacent the bottom of the draft sill. A mounting flange on the bottom of the draft sill is adjacent the bottom of the liner wherein carrier plates mounted on the mounting flange of the side wall and extending transversely across the draft sill on each side wall to form a bottom of the draft gear pocket and hold the liner in the pocket. The draft gear comprising a portion in the draft gear pocket. The draft gear is connected to the coupler, wherein the liner is adapted to line the draft sill from the inboard to the outboard ends of the pocket.

In another aspect of the present invention, the liner is adapted for use in a train car coupling assembly using an F-Type coupler wherein the liner comprises a plurality of liner sheets disposed in the draft gear pocket of a draft sill adjacent to the inside of the each of the side walls of the draft sill. The draft gear is between the liner sheets. Each liner sheet extends from the bottom of the draft sill to a position adjacent the top of the draft sill. The liner sheets also extend from adjacent the front stop in the draft gear pocket to a position adjacent the rear stop in the draft gear pocket on each respective sidewall. A plurality of mounting flange portions extend from the sidewalls. The top of the sill is connected to a top edge of each of the two sidewalls to define an inverted U-shaped draft gear pocket. The top extends between the sidewalls to support the sidewalls in spaced relation to each other. A safety plate is mounted across the bottom of the draft sill at the plurality of mounting flange portions on the bottom edge of the two sidewalls. The safety plate is connected transverse to the draft gear pocket. A draft gear carrier plate is also connected inboard from the safety plate and mounted transversely to the draft sill and the mounting flange portions.

Various types of draft gear assemblies are in use today. In addition, new draft gear assembly designs are being proposed. Each sits in the draft gear pocket of the draft sill to absorb impact form the train actions and may also have a friction interference with the sidewalls. Each type of draft gear and coupler assembly must integrate with the draft sill to minimize damage to the draft sill and reduce maintenance.

DETAILED DESCRIPTION

Figure 1:
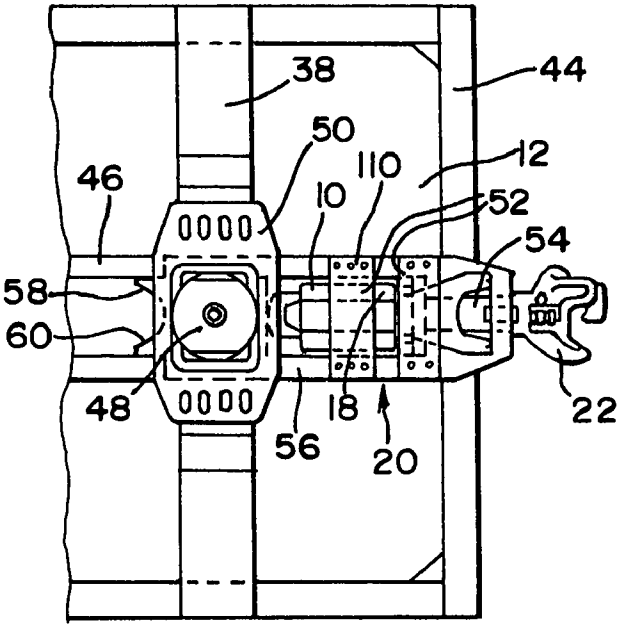
FIG. 1 is a bottom plan view of a railroad freight car body with a draft sill and coupler in place.

Referring to FIG. 1, a typical cast draft sill 20 is shown mounted to the structure of a railroad freight car 12. In the mounted position, the cast draft sill 20 is secured to an end sill 44, the body bolster 38, and a center sill 46. The draft sill 20 typically has a top wall that is welded or otherwise affixed to a shear plate that is connected to the bottom of the railway car. The railway car center sill 46 typically runs the length of the car 12 (but on some cars may extend around the periphery of the car depending on car configuration). Buff and draft forces are thus generally transferred between the draft sill 20 structure, the car truck 12 and the center sill 46 of the car 12. The draft sill 20 has a draft gear 10 mounted within a draft gear pocket 14 and coupler 16 shank 54 extended through the outboard end 21 thereof. A center filler plate 48 is mounted in the center filler plate pocket of the cast draft sill 20, such as by welding, or may be integrally formed. Center filler plate 48 is receivable within car body 12 at a center plate (not shown). A sole plate 50 connects the body bolster 38 over the cast draft sill 20. The draft gear pocket 14 has a pair of draft gear carrier members 52 mounted transversely thereto below draft gear cushioning unit 10. The draft gear carrier members 52 are connected to bottom flanges 56 of the draft sill. The end of the draft sill 20 includes a fishtail piece 58 that has a generally U-shaped opening 60.

Figure 2:
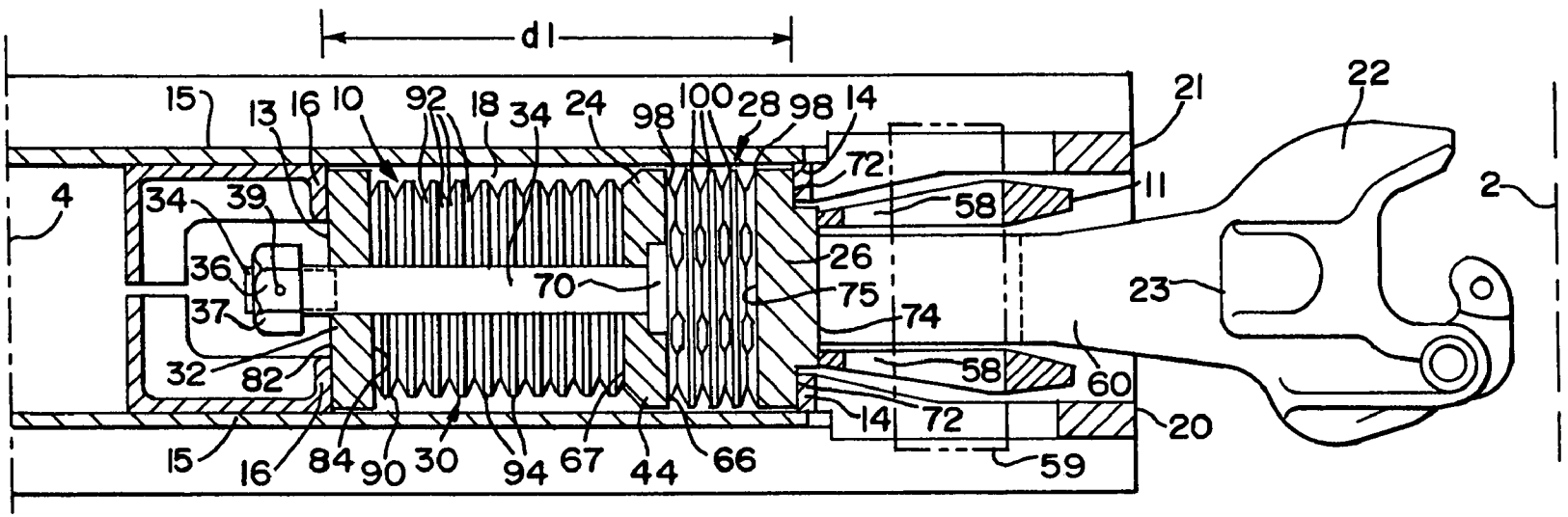
FIG. 2 is a top plan view of a prior art E-shank draft gear assembly, shown installed in a draft sill and connected to a standard E shank coupler, the coupler and draft gear assembly being shown in a full draft position, and with parts shown in cross-section.

Referring to FIG. 2, a draft gear assembly 10 is installed in a draft sill 20 with an E-type coupler 22 attached to the draft gear assembly 10. It should be understood that the principles of the present invention are also expected to be applicable to any other type of draft sill 20, draft gear assembly 10 and coupler 22 in present use or that may come into use in the future.

Throughout this description, references are made to inboard, forward or front positions or directions, and to outboard, rear, back or rearward positions or directions. The terms outboard, forward and front should be understood to refer to the longitudinally outboard position or direction shown at 2 in FIG. 2, toward the outside of the draft sill 20. The terms inboard, rear, back and rearward should be understood to refer to the longitudinally inboard position or direction toward the center of the freight railcar. In all cases, the draft sill 20 may be cast or fabricated, and may have standard features. The draft sill 20 may have a pair of laterally spaced front stops 14 proximate to the outboard end 21 and a pair of laterally spaced rear stops 16 longitudinally spaced from the front stops 14. The rear stops 16 and the front stops 14 are on the spaced sidewalls 15. The front and rear stops 14, 16, side walls 15, and top 109 (FIG. 4) define a draft gear pocket 18 between them having an inverted U-shape. The draft sill 20 may have other standard features and may be made of standard materials in standard ways.

Continuing to refer to FIG. 2, the draft gear pocket 18 is of the standard AAR size: the longitudinal distance between the inboard faces of the front stops 14 to the outboard faces of the rear stops 16 is 24⅝ inches, shown at pocket length d1 in FIG. 2. When installed, the front end 11 of draft gear assembly 10 extends past the front stops 14 of the draft sill toward the longitudinal outboard end 21 of the draft sill 20 and the back end 13 of the draft gear assembly 10 is at the back stops 16 of the draft sill 20. The draft gear assembly 10 is connected to the coupler 22 that extends in an outboard direction past the front or outboard end 21 (that is, the striker) of the draft sill 20.

Continuing to refer to FIG. 2, draft gear 10 comprises resilient members 28, 30, the followers 26, 32 and the yoke 24 in the pocket 18. The walls 15 in the prior art assembly of FIG. 2 are exposed to damage by contact with or rubbing of the resilient members 28, 30 and followers 26, 32 as the coupling 22 transfers impacts to the draft gear 10 in the buff and draft modes. The coupler 22 is connected to the draft gear 10 by shank 59 extending through key slot 58 on yoke 24. The coupler 22 and its shank 59 may have standard features known in the art.

Figure 3:
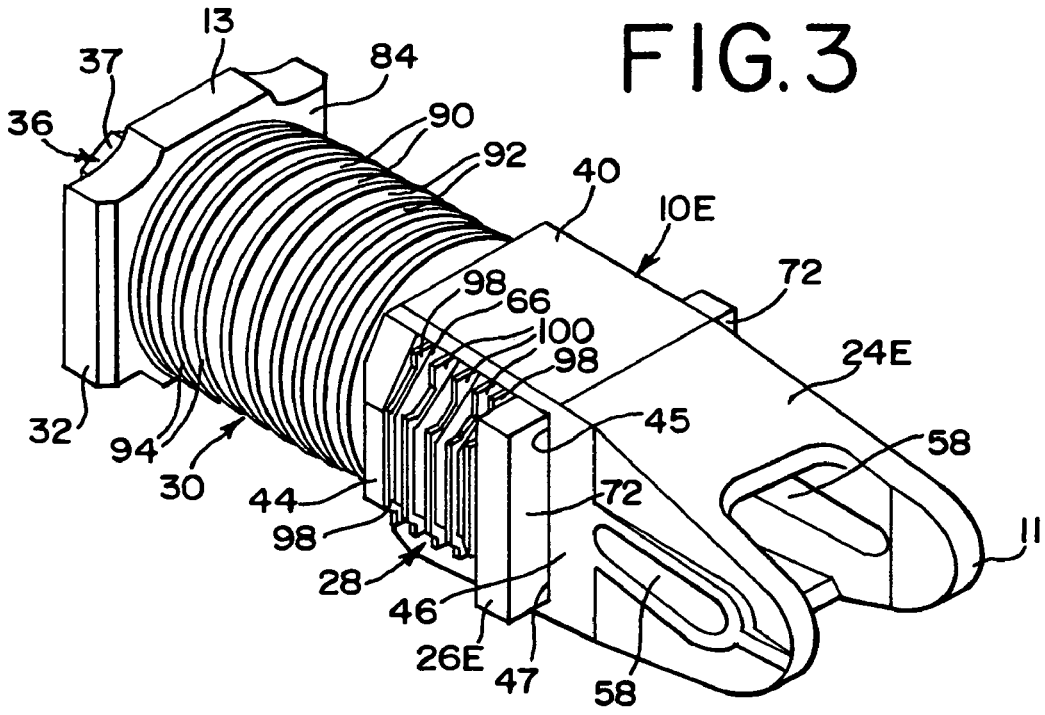
FIG. 3 is a front perspective view of an E-shank draft gear assembly for use with a draft sill and coupler, with the E-shank draft gear assembly being shown in a pre-shortened condition prior to installation in a draft sill.

Referring to FIG. 3, the draft gear assembly 10 is shown assembled. The draft gear assembly 10 includes a yoke 24, a coupler follower 26, at least one front resilient member 28, at least one back resilient member 30, and a rear follower 32. Each draft gear assembly 10 also includes a center rod 34 and a shortening member 36. The yoke 24 has a top wall 40, an integral bottom wall 42 and an integral back wall 44. The top wall 40 and bottom wall 42 are connected at the back end by the back wall 44. The top wall 40 and bottom wall 42 extend generally horizontally toward the front end 11 of the draft gear assembly. The back wall 44 extends generally vertically from the top wall 40 to the bottom wall 42. The yoke 24 also has front members 46 that extend generally vertically between the top wall 40 and bottom wall 42.

Continuing to refer to FIG. 3, the top wall 40 of each yoke 24 also has a pair of laterally aligned top stops 45 extending downward. The top stops 45 are positioned longitudinally between the back wall 44 and the front end of the yoke 24. The bottom wall 42 of each yoke of the illustrated embodiment also has a pair of laterally aligned bottom stops 47 extending upward. The bottom stops 47 are positioned longitudinally between the back wall 44 and the front end of the yoke. The stops 45, 47 are aligned to provide co-planar inboard-facing stop surfaces, the plane of the stop surfaces being vertical and extending laterally through the yoke for engaging and bearing against the front stop 14. The entire yoke 24 may comprise a steel casting, or it may be fabricated from separate steel components. The top and bottom walls 40, 42 are integral with the back wall 44 as well as with the connecting elements 46 and top and bottom stops 45,47.

Continuing to refer to FIG. 3, the resilient member 30 comprises a plurality of individual ring members 90. Each ring member 90 comprises two elastomer pads 92 bonded to a central steel ring plate 94. The elastomer pads 92 of adjacent ring members 90 bear against each other. Each ring member 90 has a hole 96 at its center, each hole having a sufficient diameter for the center rod 34 (FIG. 2) to pass through. The front resilient member 28 comprises a plurality of individual pad members 98 and three intermediate pad members 100.

Figure 4:
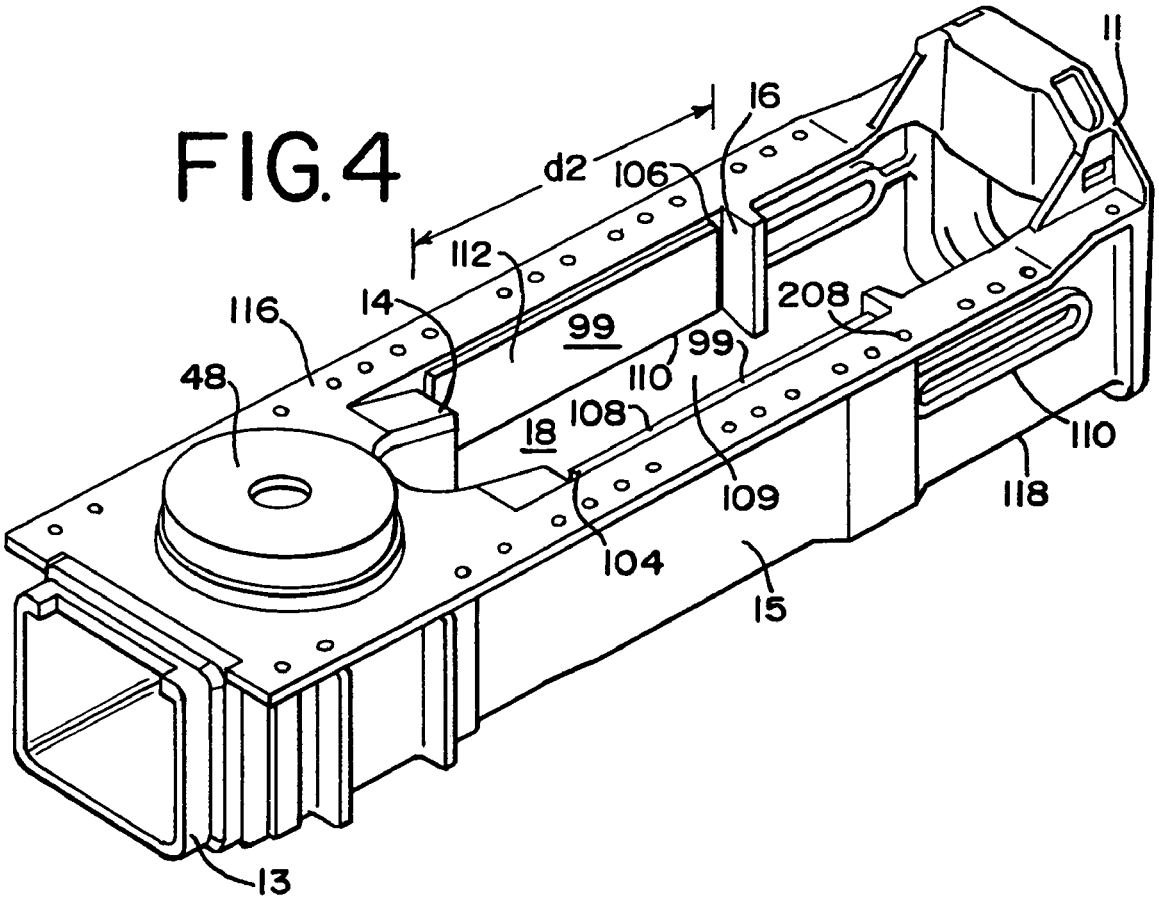
FIG. 4 is a bottom perspective view of an exemplary common draft end sill according to the present invention showing the liner in the draft gear pocket.

Referring to FIG. 4, an E-Type draft sill 20 is shown having a sill liner 99 installed in the draft gear pocket 18. The sill liner 99 has a front edge 106, a rear edge 104, a top 110 and a bottom 108. The draft liner 99 has a liner length d2 slightly shorter than the pocket length d1 of the draft gear pocket 18. In the preferred embodiment the liner 99 will have a liner length d2. The top 110 is flush with the top 109 of the draft sill 20. The mounting flange 116 extends from the sidewall 15 defining a bottom edge.

Figure 5:
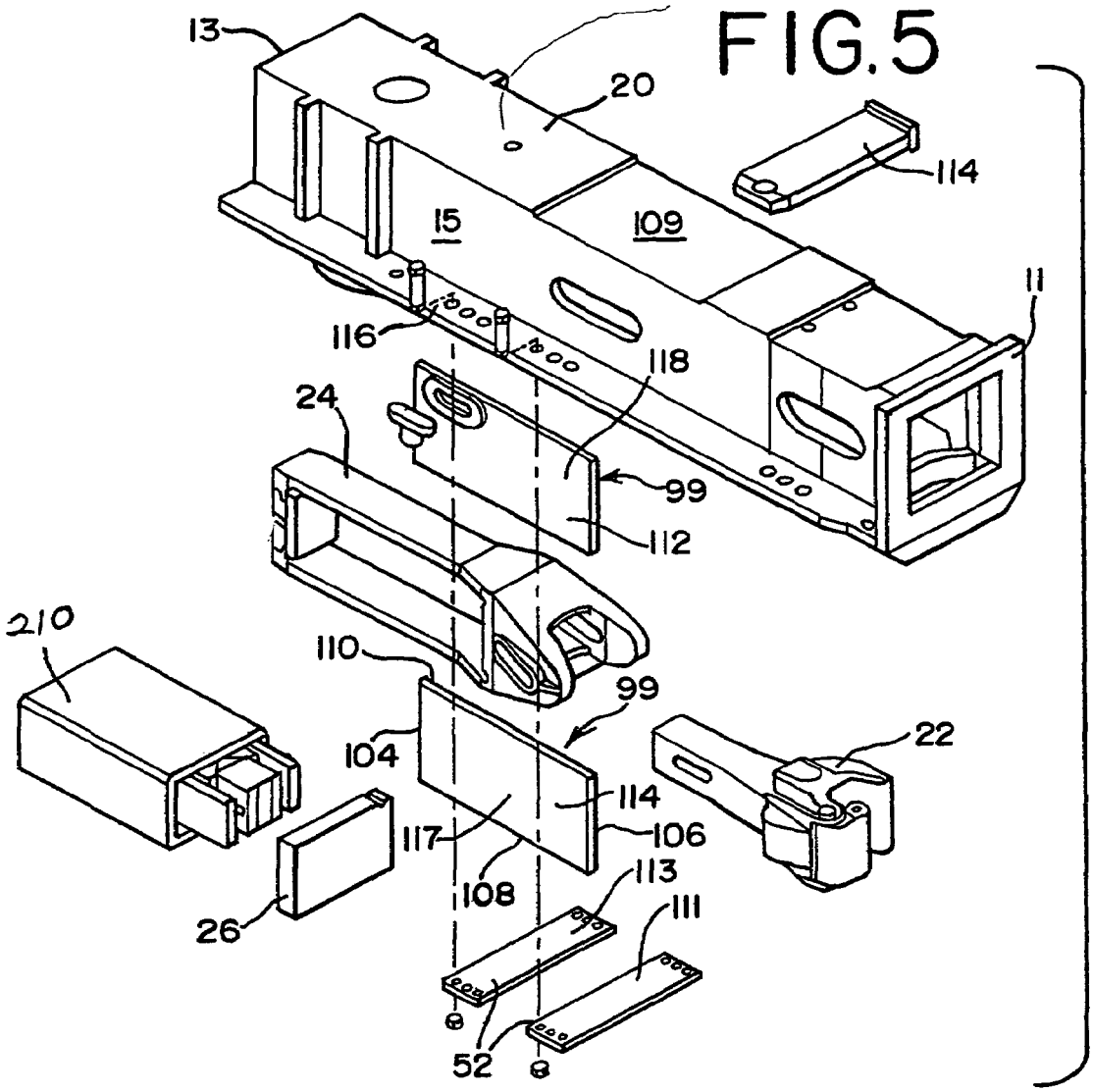
FIG. 5 is a top exploded view of a draft sill having an alternative model draft gear assembly and liner in accordance with the present invention.

Referring to FIG. 5 an exploded view of the liner 93 with an alternate type of draft gear 210 such as a Miner type draft gear 210 as available from Miner Enterprises, Inc., 1200 East State Street, PO Box 471, Geneva, Ill. 60134. The draft gear 210 and draft sill 20 are illustrated showing the liner 99 insertable in draft sill 20 and held in place by the carrier plates 52. The liner 99 is disposed between the draft gear 210 and each of the sidewalls 15 and secured by the carrier plates 52. The carrier plates 52 comprise a draft gear carrier plate 113 and safety plate 111, both attached to the bottom of the draft sill 20 at mounting flange 116. The draft gear assembly 10 comprises a coupler 22 extended into the yoke 24 having the front follower 26, rear resilient member 30 connected by a pin 59. The liner 99 comprises a pair of sheets of Ultra High Molecular material such as the POLYSTONE® M or POLYSTONE® MATROX™ product from Roechling Engineering Plastics, P.O. Box 2729, Gastonia, N.C. 28053 ASF Keystone product no. 60320. Alternatively, the liner may be made from an Ultra High Molecular Weight polyethylene such as TIVAR® 88, TIVAR® 1000 or TIVAR® H.O.T., all available through PHS Americas, Poly Hi Solidur, 2710 American Way, Fort Wayne, Ind. 46809, USA. The polymer liner material is purchased in sheets having dimensions of 0.25 inches thick±0.025 in. One sheet is placed on each side of the draft gear 10 having an inside face 112 adjacent to the draft gear 10 and an outside face 114 against the adjacent sidewall 15. The polymer liner 99 spaces the draft gear 210 from the interior of the sidewall 15.

Figure 6:
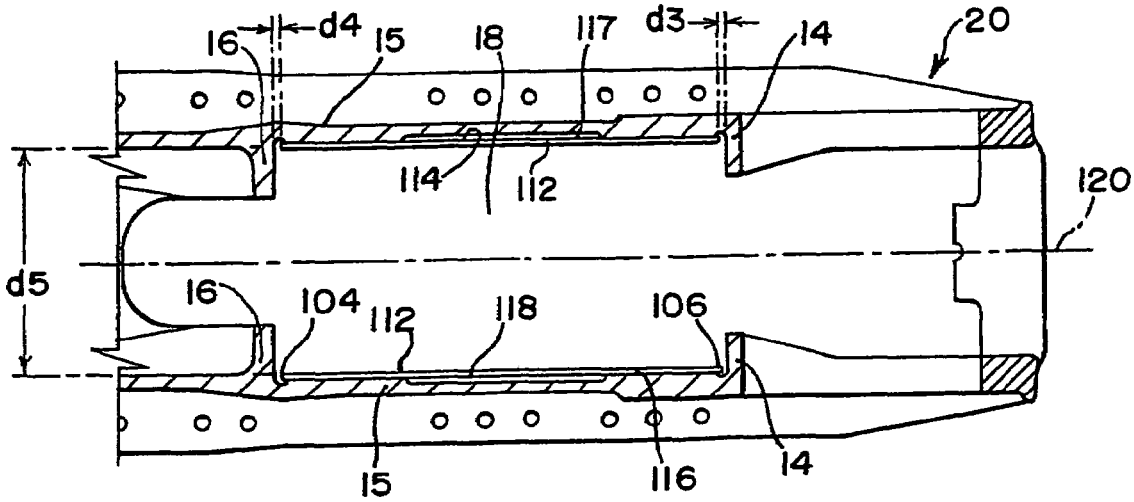
FIG. 6 is a bottom plan view of a draft sill in accordance with the present invention showing the liner installed.

Referring to FIG. 6, the draft sill 20 has draft sill liner 99 mounted therein. The liner 99 comprises a first liner sheet 117 adjacent to the first sidewall 15 and second liner sheet 118 on the opposite and facing sidewall 15. The sheets 117, 118 are parallel to sill axis 120. The front tolerance d3 between the each sheet 117, 118 and the front stop 14 is between 1/16th inch and 5/16th inches. A similar rear tolerance d4 is measured between each of the sheets 117, 118 and the respective rear stop 16. The liner 99 extends the length of the draft gear pocket 18. The draft pocket 18 has a width of a length d5 usually specified around 12⅜ inches.

Figure 7:
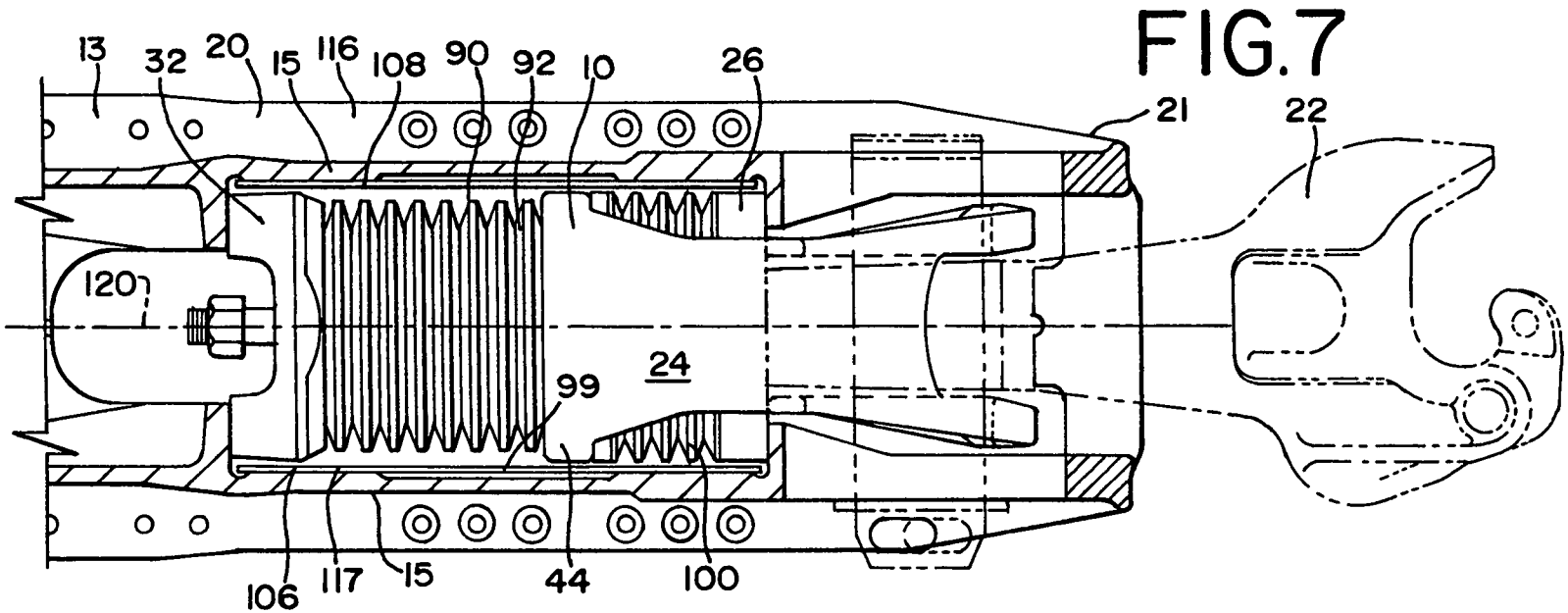
FIG. 7 is a cut away bottom view of a draft sill having a draft gear installed in accordance with the present invention
Figure 8:
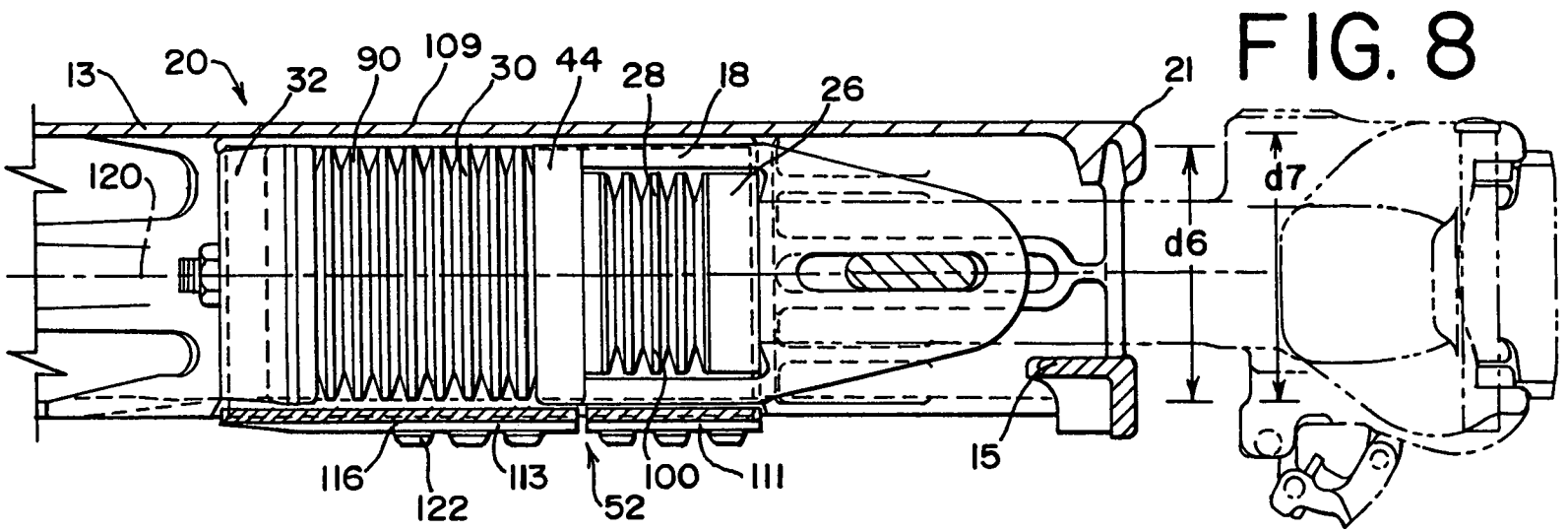
FIG. 8 is a cut away side view of a draft sill having a draft gear installed in accordance with the present invention.

Referring to FIGS. 7 and 8, the draft sill has the liner 99 comprising liner sheets 117, 118 and draft gear 10 mounted therein. In the extended draft mode, shown in FIG. 7, the coupling 22 is forced away from the draft sill 20, the movement of yoke 24 is towards the front end 21 shown in FIG. 7. This movement of the coupler 22 causes yoke 24 to move until the front resilient member 28 is compressed which may cause an expansion of pad members 100 causing contact with the liner 99 adjacent side walls 15. The liner 99 is intermediate the draft gear 10 and the draft sill 20 to separate the draft gear 10 from the sidewall 15.

Likewise, in FIG. 8, the coupler is moved as in the buff mode, wherein the coupling 22 is forced toward the draft sill 20, causing the front resilient member 28 to extend and the rear resilient member 30 to compress, thus pushing the rings 90 together and causing expansion of the rear resilient member 30 and possibly force the outer edges of the rings 90 to bear against the liner 99. The liner 99 is adapted to hold the rings 90 in spaced relation to the sidewall 15. Draft gear carrier 113 and safety plate 111 are fastened to flange 116 to support the liner 99 and prevent the liner sheets from falling out. The liner sheets 117, 118 extend to the top 109 of the draft gear pocket 18. The liner width d6 is smaller than or equal to pocket depth d7.

In use the liner 99 is used to isolate the components of the draft gear 10 namely the followers 26, 32 and the yoke 24 from the sill wall 15. Draft gear followers 26 rub against the steel, cast or fabricated, draft sill 20 causing wear and friction. Depending on the wear, the sidewall 15 must be repaired to insure safety of the system. The liner 99 and the draft gear 10 are more easily replaced than the draft sill 20. To prevent the wear on the draft sill 20, the liner is slipped in on both sides of the draft gear 10 to space the follower 26 from the sidewalls 15. The liner sheets 117, 118 are placed in the draft gear pocket 18 between the first stop 14 and the second stop 16. Fasteners are usually not required to hold the sheets 117, 118 in place. The carrier plates 52 are attached to the mounting flange to keep the sheets from falling out of the pocket 18. The carrier plates 52 are removably held in place by fasteners 122 extending through the plates and the flange 116. No modifications of the draft sill 20 is usually necessary for use with the liner 99 of the present invention.

The draft sill forms an inverted U-shaped channel having the top attached to the rail car. The sidewalls and the top bound the draft sill interior. The carrier plates removably attached to the mounting flange on the sidewalls closes the bottom. The channel may be an open rectangular shaped cavity for receiving the draft gear therein, and having the liner sheets between the draft gear and the sidewalls. The liner sheets 117, 118 are inserted into the draft sill and seated between the front and rear stop to line the draft gear pocket. The draft gear 10 is inserted between the sheets. The draft gear and liner is held in place by the carrier plates 52 fastened to the mounting flange on the sidewall. The liner sheets may wear and need replacement before the draft gear or draft sill need servicing. The carrier plates 52 may be removed to pull out the worn liner sheets. New liner sheets are inserted vertically next to each sidewall in the draft gear pocket. The sheets are placed adjacent to the draft gear and between the draft gear and the respective sidewall so the draft gear is between the liner sheets. The carrier plates 52 are reattached to hold the draft gear and liner sheets in the draft gear pocket.

When a draft load, that is, a load tending to pull the coupler in a longitudinally outboard direction, greater than about 25,000-30,000 pounds is experienced, the coupler 22 moves longitudinally outboard. The draft system should reach the full draft position when the coupler 22 receives a load of 650,000 pounds, nominally, in the illustrated embodiment. The coupler and the yoke 24 both move in response to a draft impact. The full draft stroke for the coupler and yoke 24 is ¼(1.25) inches, nominally. The draft sill liner may be used with standard cast or fabricated draft sills. In the full draft position, the coupler pulls against the coupler key 59 which pulls the yoke 24 forward a distance of about 1.25 nominal inches, compressing the front resilient member 28. Simultaneously, the back resilient member 30 expands by approximately 1.25 inches.

Although the invention has been described above in connection with particular embodiments and examples, it will be appreciated by those skilled in the art that the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

What is claimed is:

1. A rail car coupling assembly comprising:

a draft sill having a front end, a back end, a top, and two side walls, the side walls extending downward from the top in spaced relation to form a draft gear pocket between the side walls and the top, a front stop on each side wall adjacent the front end, a rear stop on each side wall longitudinally spaced from the front stops, a mounting flange extending from the bottom of each of the side walls;

a liner in the draft gear pocket, the liner comprising a sheet of a polyethylene material, the sheet aligned with and adjacent to one of the two side walls, the sheet on the top of the draft sill and extending to a position proximate to the mounting flange on the one of the two side walls, a carrier plate transversely mounted between the two side walls on the mounting flange, the liner further comprising a second sheet of polyethylene material, the second sheet adjacent a second of the two side walls, the liner held in place between the top and the carrier plate, the liner intermediate the front stop and the rear stop.

2. The invention of claim 1 wherein the sheets have a thickness of about 0.25 inches, the sheets having a length of about 24 inches whereby the sheet fits between the front stop and rear stop of each respective side wall.

3. The invention of claim 1 further comprising a draft gear in the draft gear pocket, the draft gear intermediate the first sheet and the second sheet whereby the draft gear is isolated from the sidewalls by the liner.

4. A rail car coupling assembly comprising:

a draft sill having a top, an outboard end, a back end and two side walls, the side walls each comprising a front stop adjacent the front end, a rear stop adjacent the back end, the side walls extending from the top to form a U-shaped structure, a draft gear pocket intermediate the front stops and the rear stops;

a liner in the draft gear pocket, the liner comprising a first sheet and a second sheet of ultra high molecular weight polyethylene material, each of the sheets having a sheet thickness of about 0.25 inches, each of the sheets having a liner length of about 24 inches, the sheets each having a top edge on the top of the draft sill, the first sheet disposed intermediate the side walls and adjacent to a first one of the two side walls, the first sheet intermediate the front stop and the rear stop on the adjacent side walls, the second sheet intermediate the first sheet and second sheet of the two side walls, the second sheet adjacent the second of the two side walls and intermediate the front stop and rear stop on the second of the two side walls;

a draft gear in the draft sill, the drafting gear having a portion in the draft hear pocket between the first sheet and the second sheet.

* * * * *